US009586217B2

(12) United States Patent
Arminak

(10) Patent No.: US 9,586,217 B2
(45) Date of Patent: Mar. 7, 2017

(54) MIXING CHAMBER FOR TWO FLUID CONSTITUENTS

(71) Applicant: Arminak & Associates, LLC, Azusa, CA (US)

(72) Inventor: Armin Arminak, Pasadena, CA (US)

(73) Assignee: Arminak & Associates, LLC, Irwindale, CA (US)

( * ) Notice: Subject to any disclaimer, the term of this patent is extended or adjusted under 35 U.S.C. 154(b) by 0 days.

(21) Appl. No.: 13/826,159

(22) Filed: Mar. 14, 2013

(65) Prior Publication Data

US 2014/0097205 A1 Apr. 10, 2014

Related U.S. Application Data

(60) Provisional application No. 61/709,586, filed on Oct. 4, 2012.

(51) Int. Cl.
*B67D 7/78* (2010.01)
*B05B 7/00* (2006.01)
(Continued)

(52) U.S. Cl.
CPC ..... *B05B 7/0018* (2013.01); *A47K 5/14* (2013.01); *B01F 3/04446* (2013.01);
(Continued)

(58) Field of Classification Search
CPC . B05B 11/3087; B05B 7/0037; B05B 7/2416; A47K 5/14; A47K 5/16; A47K 5/1217; A47K 5/1211
(Continued)

(56) References Cited

U.S. PATENT DOCUMENTS 3,997,634 A * 12/1976 Downs ..... 261/122.2
4,597,530 A * 7/1986 Goudy et al. ..... 239/452
(Continued)

FOREIGN PATENT DOCUMENTS

EP 1428580 A1 6/2004
JP 02-268763 11/1990
(Continued)

OTHER PUBLICATIONS

International Search Report and Written Opinion issued in PCT/US2013/062996, dated Jan. 17, 2014.
(Continued)

*Primary Examiner* — Kevin P Shaver
*Assistant Examiner* — Michael J Melaragno
(74) *Attorney, Agent, or Firm* — Woodard Emhardt Moriarty McNett & Henry LLP

(57) ABSTRACT

A mixing chamber for two fluid constituents is disclosed which provides improved mixing before the mixture is pushed through a mesh insert for the production of foam. Foam production using air and liquid is the basis of the exemplary embodiment though the disclosed mixing chamber could be used for any two fluid constituents. A single stream of air is diffused into a plurality of smaller streams of air. The single stream of liquid is directed into an annular sleeve resulting in a thinner wall of liquid flow as compared to the entering liquid stream. This annular sleeve of a thinner wall of liquid flow surrounds the plurality of smaller streams of air. In a second embodiment, there are individual streams of liquid which are directed inwardly toward the individual streams of air. The mixing chamber construction is disclosed herein can be used for any two fluid constituents which would benefit for more thorough mixing.

21 Claims, 8 Drawing Sheets

(51) Int. Cl.

| | |
|---|---|
| ***B05B 7/26*** | (2006.01) |
| ***A47K 5/14*** | (2006.01) |
| ***B01F 5/06*** | (2006.01) |
| ***B01F 3/04*** | (2006.01) |

(52) U.S. Cl.
CPC ..... *B01F 5/0693* (2013.01); *B05B 7/0025* (2013.01); *B05B 7/0037* (2013.01); *B05B 7/267* (2013.01)

(58) Field of Classification Search
USPC ..... 222/145.5, 190, 135, 52, 394; 239/10, 239/311, 518, 589, 76
See application file for complete search history.

(56) References Cited

U.S. PATENT DOCUMENTS

| | | | | |
|---|---|---|---|---|
| 4,901,925 | A * | 2/1990 | Blake, III | B05B 7/0037 222/190 |
| 4,925,109 | A * | 5/1990 | Flanagan et al. | 239/429 |
| 4,991,779 | A * | 2/1991 | Blake, III | 239/343 |
| 5,054,688 | A * | 10/1991 | Grindley | 239/407 |
| 5,186,363 | A * | 2/1993 | Haynes | 222/145.5 |
| 5,222,633 | A * | 6/1993 | Blake | 222/179 |
| 5,238,155 | A * | 8/1993 | Blake, III | A45D 27/10 222/190 |
| 5,269,444 | A | 12/1993 | Wright | |
| 5,415,326 | A * | 5/1995 | Durham et al. | 222/129.1 |
| 5,645,223 | A | 7/1997 | Hull et al. | |
| 5,732,885 | A * | 3/1998 | Huffman | B05B 7/0892 239/416.5 |
| 5,950,875 | A * | 9/1999 | Lee et al. | 222/145.5 |
| 6,082,586 | A * | 7/2000 | Banks | 222/95 |
| 6,171,082 | B1 * | 1/2001 | Hankner et al. | 417/477.12 |
| 6,547,162 | B1 * | 4/2003 | de Regt et al. | 239/333 |
| 7,059,543 | B2 * | 6/2006 | Dushkin et al. | 239/390 |
| 7,108,156 | B2 * | 9/2006 | Fox | 222/129.1 |
| 7,191,920 | B2 * | 3/2007 | Boll et al. | 222/333 |
| 7,431,182 | B2 * | 10/2008 | Ciavarella | 222/321.9 |
| 7,458,523 | B2 * | 12/2008 | Hyslop | 239/67 |
| 7,766,194 | B2 | 8/2010 | Boll et al. | |
| 7,819,289 | B2 * | 10/2010 | Willis | 222/190 |
| 7,823,751 | B2 * | 11/2010 | Ophardt et al. | 222/137 |
| 7,850,048 | B2 * | 12/2010 | Arminak | 222/190 |
| 7,850,049 | B2 * | 12/2010 | Ciavarella et al. | 222/190 |
| 7,938,297 | B2 * | 5/2011 | Law et al. | 222/190 |
| 8,002,151 | B2 * | 8/2011 | Matthews et al. | 222/190 |
| 8,056,768 | B2 * | 11/2011 | Snodgrass | 222/190 |
| 8,096,530 | B2 * | 1/2012 | Pelfrey | 261/28 |
| 8,141,744 | B2 * | 3/2012 | Quinlan | 222/61 |
| 8,172,555 | B2 * | 5/2012 | Reynolds | 417/413.1 |
| 8,201,707 | B2 * | 6/2012 | Ophardt | 222/1 |
| 8,215,521 | B2 * | 7/2012 | Quinlan | 222/1 |
| 8,231,111 | B2 * | 7/2012 | Chang | 261/79.2 |
| 8,281,958 | B2 * | 10/2012 | Matthews et al. | 222/190 |
| 8,286,836 | B2 * | 10/2012 | Yates | 222/190 |
| 8,348,105 | B2 * | 1/2013 | Wong et al. | 222/333 |
| 8,544,698 | B2 * | 10/2013 | Ciavarella et al. | 222/207 |
| 8,651,337 | B2 * | 2/2014 | Quinlan et al. | 222/190 |
| 8,662,355 | B2 * | 3/2014 | Spiegelberg et al. | 222/190 |
| 8,672,187 | B2 * | 3/2014 | Ophardt | 222/145.5 |
| 8,733,596 | B2 * | 5/2014 | Ophardt et al. | 222/190 |
| 8,807,358 | B2 * | 8/2014 | Devoy | B01F 3/0446 215/309 |
| 8,813,999 | B2 * | 8/2014 | Cittadino | 222/1 |
| 2002/0179641 | A1 * | 12/2002 | Emmons | 222/145.5 |
| 2005/0077383 | A1 * | 4/2005 | Sevy | 239/290 |
| 2005/0139612 | A1 * | 6/2005 | Matthews et al. | 222/190 |
| 2005/0258192 | A1 * | 11/2005 | Matthews | A47K 5/14 222/190 |
| 2007/0023454 | A1 * | 2/2007 | Ophardt | A47K 5/14 222/190 |
| 2007/0194054 | A1 * | 8/2007 | Ganzeboom et al. | 222/190 |
| 2007/0278247 | A1 * | 12/2007 | Banks et al. | 222/132 |
| 2008/0237266 | A1 * | 10/2008 | Ciavarella | A47K 5/14 222/190 |
| 2009/0008412 | A1 * | 1/2009 | Choi et al. | 222/190 |
| 2009/0184134 | A1 * | 7/2009 | Ciavarella et al. | 222/135 |
| 2009/0266840 | A1 * | 10/2009 | Brand et al. | 222/1 |
| 2010/0051642 | A1 * | 3/2010 | Wong et al. | 222/52 |
| 2010/0089951 | A1 * | 4/2010 | Yates | B05B 7/0037 222/190 |
| 2010/0206909 | A1 * | 8/2010 | O'Brien | 222/190 |
| 2011/0006086 | A1 * | 1/2011 | Yates | 222/190 |
| 2011/0017778 | A1 * | 1/2011 | Kadiks et al. | 222/190 |
| 2011/0180172 | A1 * | 7/2011 | Gledhill et al. | 138/111 |
| 2011/0251277 | A1 * | 10/2011 | Matthews et al. | 514/552 |
| 2011/0284586 | A1 * | 11/2011 | Kerr et al. | 222/190 |
| 2011/0286870 | A1 * | 11/2011 | Bach | 417/474 |
| 2012/0160879 | A1 * | 6/2012 | Ciavarella et al. | 222/409 |
| 2012/0217267 | A1 * | 8/2012 | Bunoz et al. | 222/145.5 |
| 2013/0037571 | A1 * | 2/2013 | Bodet et al. | 222/145.5 |
| 2013/0075420 | A1 * | 3/2013 | Tramontina et al. | 222/1 |
| 2013/0175296 | A1 * | 7/2013 | Gray et al. | 222/135 |
| 2013/0200098 | A1 * | 8/2013 | Li | A47K 5/16 222/52 |
| 2013/0206794 | A1 * | 8/2013 | McNulty et al. | 222/136 |
| 2013/0284763 | A1 * | 10/2013 | Banks et al. | 222/190 |
| 2013/0291947 | A1 * | 11/2013 | Chandler et al. | 137/1 |
| 2013/0299518 | A1 * | 11/2013 | McNulty et al. | 222/190 |
| 2013/0302195 | A1 * | 11/2013 | McNulty et al. | 417/545 |
| 2013/0315031 | A1 * | 11/2013 | Bunoz et al. | 366/182.2 |
| 2014/0008394 | A1 * | 1/2014 | Hofte | 222/190 |
| 2014/0034679 | A1 * | 2/2014 | Fitzpatrick et al. | 222/190 |
| 2014/0054324 | A1 * | 2/2014 | Arminak | 222/190 |
| 2014/0061247 | A1 * | 3/2014 | Arminak et al. | 222/190 |
| 2014/0076924 | A1 * | 3/2014 | Liang | A47K 5/16 222/52 |
| 2014/0097204 | A1 * | 4/2014 | Hsu et al. | 222/145.5 |
| 2014/0097205 | A1 * | 4/2014 | Arminak | 222/145.5 |
| 2014/0103069 | A1 * | 4/2014 | Laible | 222/136 |
| 2014/0209639 | A1 * | 7/2014 | Sasaki | B05B 7/0037 222/190 |

FOREIGN PATENT DOCUMENTS

| | | |
|---|---|---|
| JP | 2007/000837 | 1/2007 |
| JP | 2013-209153 A | 10/2013 |
| WO | WO 92/00768 | 1/1992 |
| WO | WO 01/85356 A1 | 11/2001 |
| WO | WO 2007/143497 | 12/2007 |

OTHER PUBLICATIONS

International Search Report and Written Opinion issued in PCT/US2014/063024, dated Jan. 30, 2015, 11 pgs.
EP Search Report dated Sep. 28, 2015 in EP 13843606.8.

* cited by examiner

MIXING CHAMBER FOR TWO FLUID CONSTITUENTS

CROSS-REFERENCE TO RELATED APPLICATIONS

This application claims the benefit of U.S. Provisional Application No. 61/709,586, filed Oct. 4, 2012, which is incorporated herein in its entirety.

BACKGROUND

Currently there are various dispensing devices which are constructed for handling a mixture of two fluid constituents. One example or category of such a dispensing device is a foam dispenser where the two fluid constituents are air and a liquid, such as liquid soap. The production of foam requires a mixing of the air and the liquid, and an initial mixing may occur prior to pushing those two constituents through a mesh or screen for bubble production by aeration. The quality of the produced foam is dependent in part on the degree or thoroughness of the mixing of the two constituents.

SUMMARY

A mixing chamber for two fluid constituents is disclosed which provides improved mixing before the mixture is pushed through a mesh insert for the production of foam. Foam production using air and liquid is the basis of the exemplary embodiment though the disclosed mixing chamber could be used for any two fluid constituents.

A single stream of air is diffused into a plurality of smaller streams of air. In the exemplary embodiment an air diffusing structure is used and is inserted into the air flow stream. When the single flow stream of air contacts the air diffusing structure, that single stream of air is separated and directed into a plurality of air channels which account for the plurality of smaller streams of air.

The single stream of liquid is directed into an annular sleeve which defines a generally cylindrical cavity which extends around at least a portion of the air diffusing structure. This cavity configuration results in the creation of a thinner wall of liquid flow as compared to the larger or greater flow cross section of the entering liquid stream. This annular sleeve of a thinner wall of liquid flow surrounds the plurality of smaller streams of air.

In a second embodiment, there are individual streams of liquid which are directed inwardly toward the individual streams of air. The mixing chamber construction disclosed herein can be used for any two fluid constituents, including those which might benefit from more thorough mixing.

Further forms, objects, features, aspects, benefits, advantages, and embodiments of the present invention will become apparent from a detailed description and drawings provided herewith.

DESCRIPTION OF THE SELECTED EMBODIMENTS

Figure 1:
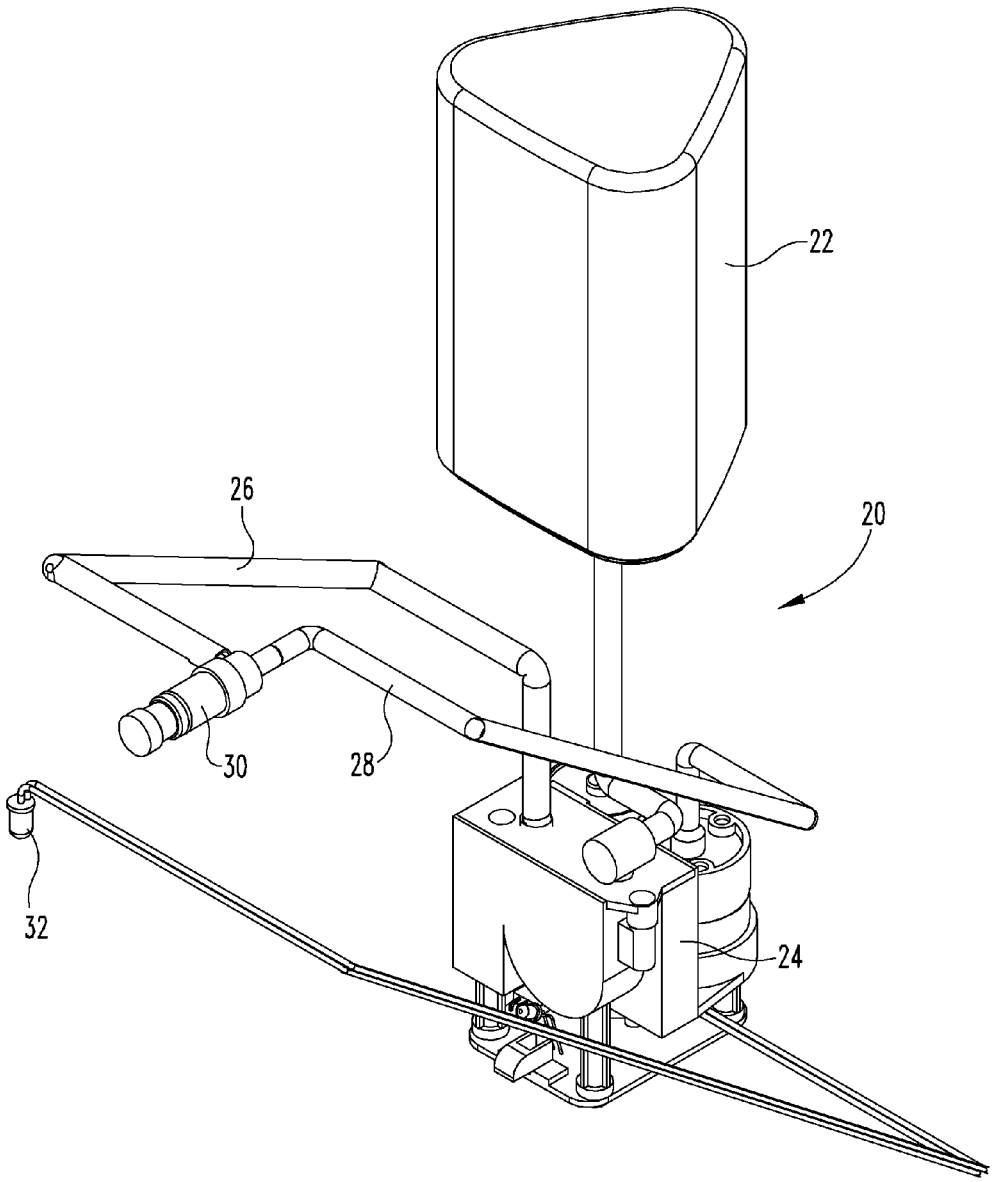
FIG. 1 is a perspective view of one type of dispensing device which can utilize the mixing chamber constructions which are disclosed herein

For the purpose of promoting an understanding of the principles of the invention, reference will now be made to the embodiments illustrated in the drawings and specific language will be used to describe the same. It will nevertheless be understood that no limitation of the scope of the invention is thereby intended. Any alterations and further modifications in the described embodiments, and any further applications of the principles of the invention as described herein are contemplated as would normally occur to one skilled in the art to which the invention relates. One embodiment of the invention is shown in great detail, although it will be apparent to those skilled in the relevant art that some features that are not relevant to the present invention may not be shown for the sake of clarity.

Figure 2:
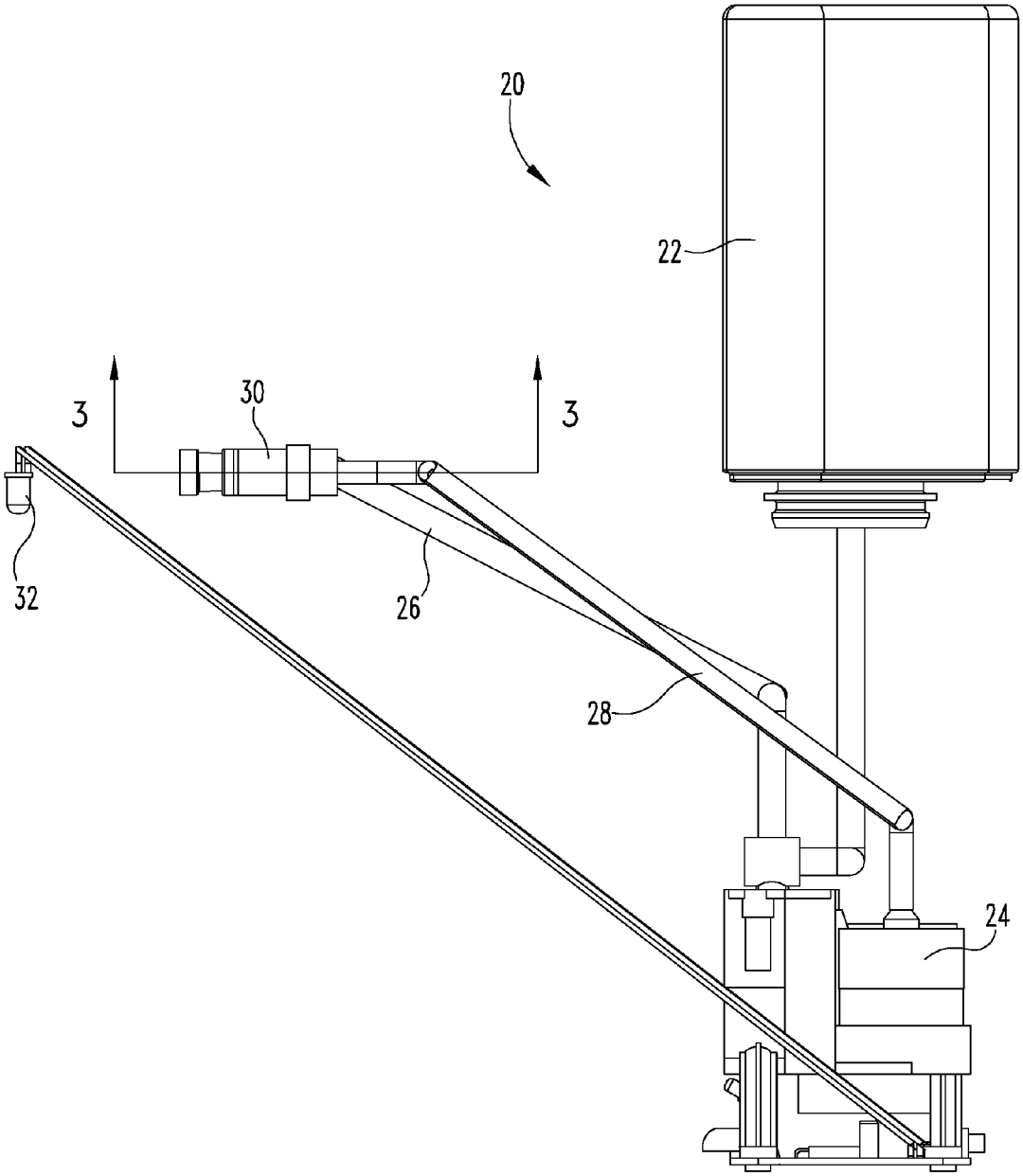
FIG. 2 is a side elevational view of the FIG. 1 dispensing device.
Figure 3:
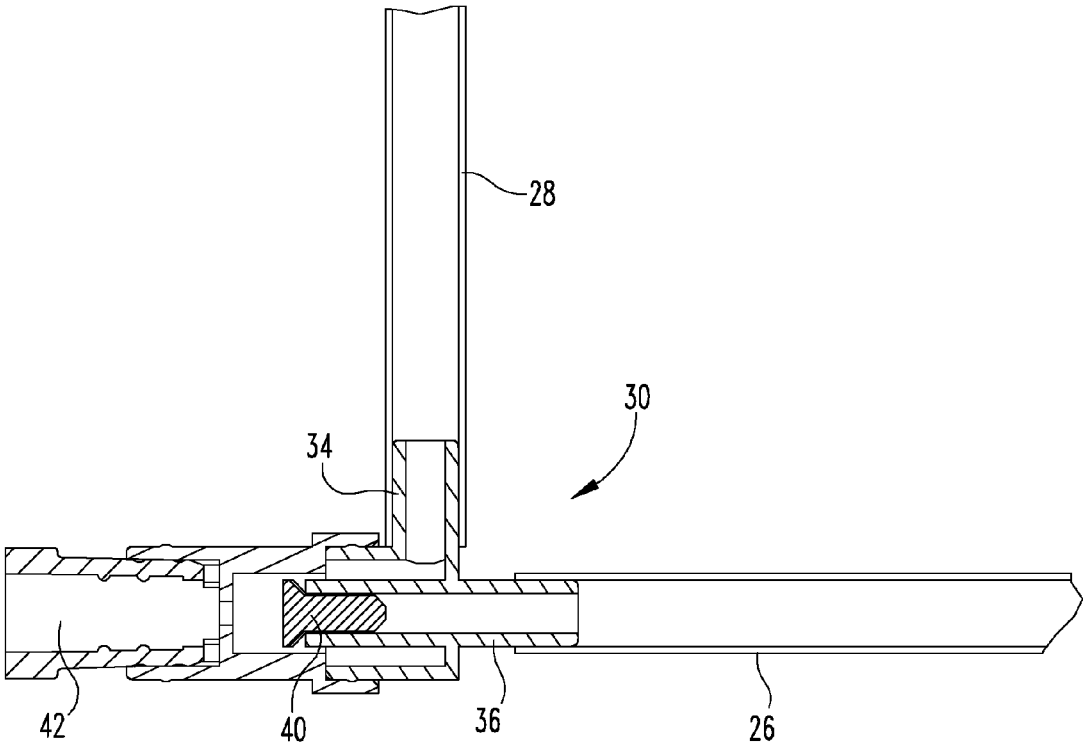
FIG. 3 is a partial, top plan view of a first mixing chamber construction which is a part of the FIG. 1 dispensing device.

Referring to FIGS. 1, 2 and 3, there is illustrated a dispensing device 20 which includes a liquid reservoir 22, pumping station 24, a liquid conduit 26, and air conduit 28, a mixing chamber 30 and a proximity sensor 32. In operation, once the dispensing device is properly packaged or housed and installed in the desired location, foam soap is dispensed into the hand of the user, once the presence of the user is sensed. While another substance or mixture can be produced and delivered, the exemplary embodiment focuses on a mixture of air and liquid soap for producing soap with a foam consistency.

The pumping station 24 is constructed and arranged to generate a flow of air which travels via conduit 28 to mixing chamber 30. The pumping station is also constructed and arranged to draw a dose of liquid, in the exemplary embodiment liquid soap, from the reservoir 22 and via conduit 26, deliver that does of liquid to the mixing chamber 30.

Figure 4:
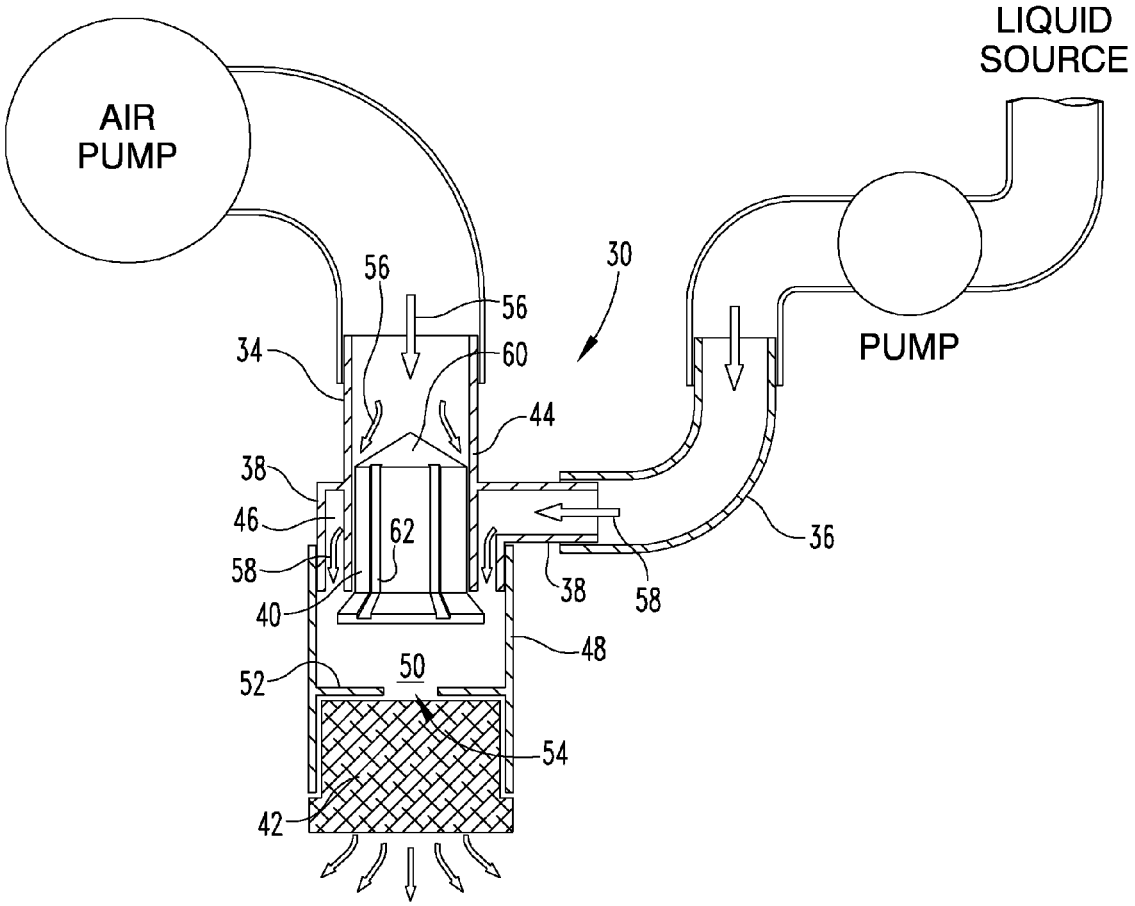
FIG. 4 is a diagrammatic view of the FIG. 3 mixing chamber.
Figure 4A:
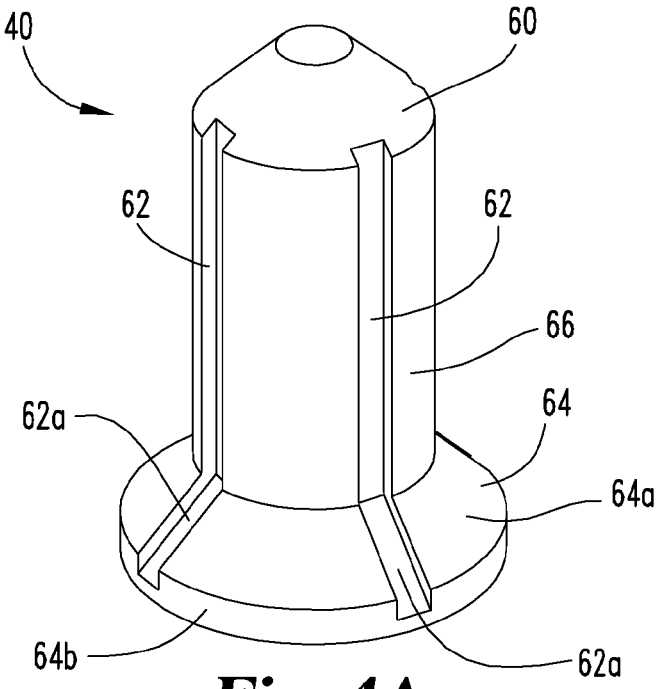
FIG. 4A is a perspective view of an air diffuser used in the FIG. 3 mixing chamber.

Referring now to FIGS. 4 and 4A, the mixing chamber is constructed and arranged with an air inlet 34, a liquid inlet 36, a housing 38, an air diffuser 40 and a mesh insert 42. Sleeve 44 which defines the air inlet 34 receives the air diffuser 40. A portion of housing 38 connects the liquid inlet 36 with sleeve 44 so as to define a generally cylindrical cavity or space 46 surrounding sleeve 44. The details of air diffuser 40 are illustrated in FIG. 4A.

Air inlet 34 which is defined in part by sleeve 44 is generally cylindrical and is constructed and arranged for a close surrounding fit or arrangement relative to air diffuser 40. This close surrounding fit or arrangement may be achieved by a sliding fit which would be virtually line-to-line with air diffuser 40. However, even if slight clearance is left between sleeve 44 and air diffuser 40, this slight clearance does not constitute an adequate air flow pathway. Further, the air flow pathways of least resistance, due to size, are the defined air flow channels 62. Sleeve 44 ends at approximately the juncture between the body 66 of the air diffuser 40 and its skirt 64.

In the exemplary embodiment the air inlet 34 and housing 38 are a unitary, integral component part. As such, housing extension 48 connects to housing 38 with a sliding fit. This interface needs to be sealed against leakage and this may be achieved by dimensioning the parts for a tight press fit or by the use of an adhesive or by ultrasonic welding.

One design variation which is contemplated is to make housing extension 48 and housing 38 a unitary, integral component part. This design approach would result in redesigning the air inlet so that it would be received by or assembled onto (or into) a portion of housing 38.

Housing extension 48 connects to housing 38 and in cooperation therewith defines mixing pocket 50 which is generally between the air diffuser 40 and the mesh insert 42. Housing extension 48 includes a shelf 52 which defines mixture opening 54 for passage of the air and liquid mixture from pocket 50 into the mesh insert 42.

The air diffuser 40 has an axial length which extends from the outer surface of the conical top 60 to the lower edge of the skirt 64. The air diffuser 40 has an outer surface and the flow of incoming air flows axially over the outer surface of the diffuser for the entirety of the axial length of the diffuser in order to be able to reach the mixing pocket 50. All mixing of the constituents occurs exteriorly of the diffuser 40.

In use, the mixing chamber 30 receives air via air inlet 34 and liquid via liquid inlet 36. Arrows 56 denote the air flow and arrows 58 denote the liquid flow. The air flows onto the conical top 60 of the air diffuser 40 and the four substantially equally-spaced channels 62 defined by the generally cylindrical body 66 of the air diffuser 40 (see FIG. 4A) create four smaller air flow streams extending or flowing axially in the direction of mixing pocket 50. Conical top 60 is the proximal end of air diffuser 40 relative to the incoming air flow (arrows 56). As illustrated in FIG. 4A, the proximal end 60 faces the incoming air flow (arrows 56). While four air channels 62 are shown for the exemplary embodiment, a larger number is contemplated and while a smaller number of air channels can be used, the mixing would be expected to be less thorough. The base or skirt 64 of the air diffuser 40 includes an upper portion 64*a* which is shaped as a generally frustoconical form and a lower portion 64*b* which is generally cylindrical. The upper portion 64a defines the plurality of equally-spaced air channels 62*a*. Each air channel 62*a* is in flow communication with an aligned and corresponding one of air channels 62. The cooperating nature of air channel 62*a* results in each such channel receiving one air flow stream from a corresponding air channel 62 and thereafter directs its air flow stream radially outwardly. This outwardly directing of the air flow streams causes those air flow streams to travel into the sleeve of liquid which is flowing through cylindrical space 46. The intersection of these flows (air and liquid) creates initial mixing of the air and liquid. This mixing of air and liquid continues into mixing pocket 50. As illustrated, the air channels 62*a*break out through the outer surface of the generally cylindrical lower portion 64*b*.

Figure 4B:
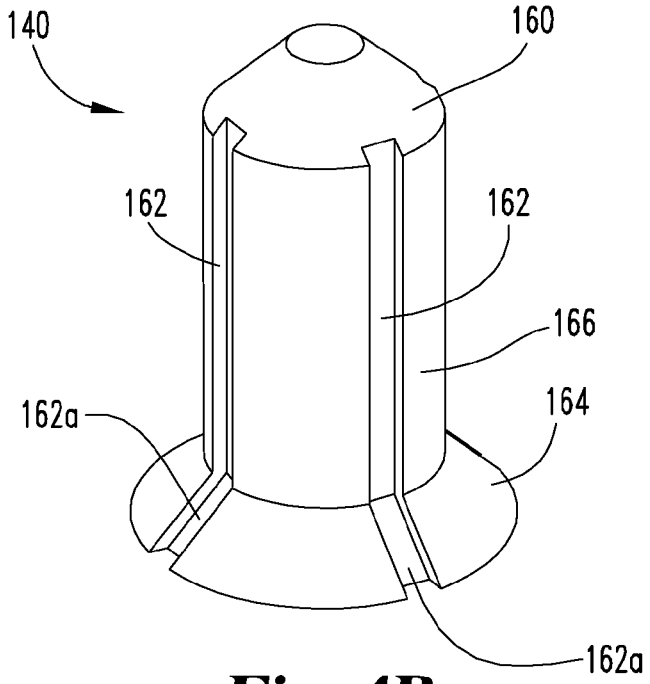
FIG. 4B is a perspective view of an alternative air diffuser.

The alternative diffuser 140 which is illustrated in FIG. 4B is similar to diffuser 40, but with a slightly different shaping. Diffuser 140 includes a conical top 160, a generally cylindrical body 166, air channels 162 defined by the body and a frustoconical skirt 164 defining air channels 162*a*. In comparing air diffuser 140 with air diffuser 40, it will be seen that a corresponding lower portion of a generally cylindrical shape is not included as a part of air diffuser 140.

Figure 4C:
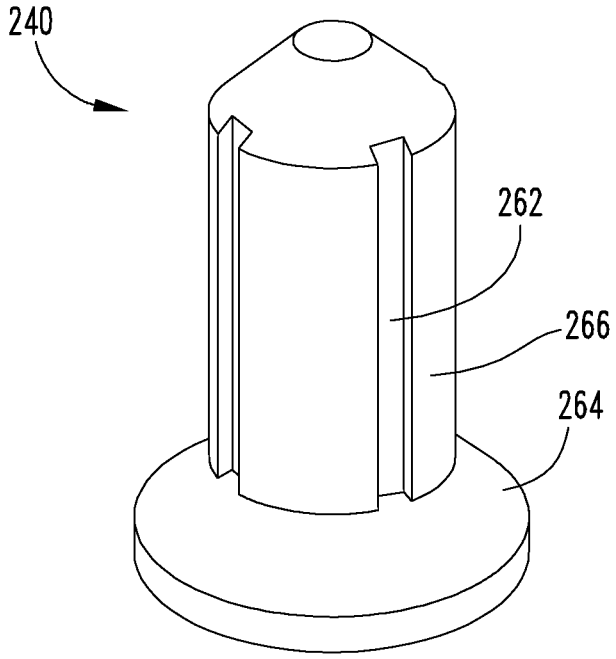
FIG. 4C is a perspective view of an alternative air diffuser.

A further design variation which is contemplated and illustrated in FIG. 4C is to have each air channel 262 of diffuser 240 end or be closed off at the juncture between the generally cylindrical body 266 of the diffuser 240 and skirt 264. Body 266 defines the four air channels 262 or whatever number of air channels one might select. By filling in or closing off any air channel portions in the skirt, the skirt 264 becomes a deflector for the air flow streams from air channels 262 rather than functioning as a director of those air flow streams.

The incoming stream of liquid enters the mixing chamber as a single stream and then spreads out into a generally cylindrical flow stream, essentially forming a sleeve of liquid flowing through cylindrical space 46 and surrounding the air flow. The single stream of incoming liquid is reshaped into a sleeve whose wall thickness is less or smaller when compared to the thickness of the incoming single flow stream. Then, when the individual streams of air deflect outwardly and intersect the sleeve of liquid, multiple mixing intersections and interactions occur at circumferentially spaced locations. By placing the air flow and its individual streams radially inside of the liquid flow which is rearranged into a generally cylindrical flow sleeve, the air and liquid mix at multiple sites and this mixing at multiple sites is an improvement as compared to mixing which is based on air flowing into a single stream of liquid which has a rod shape instead of a sleeve shape as provided by the disclosed embodiments.

Figure 5:
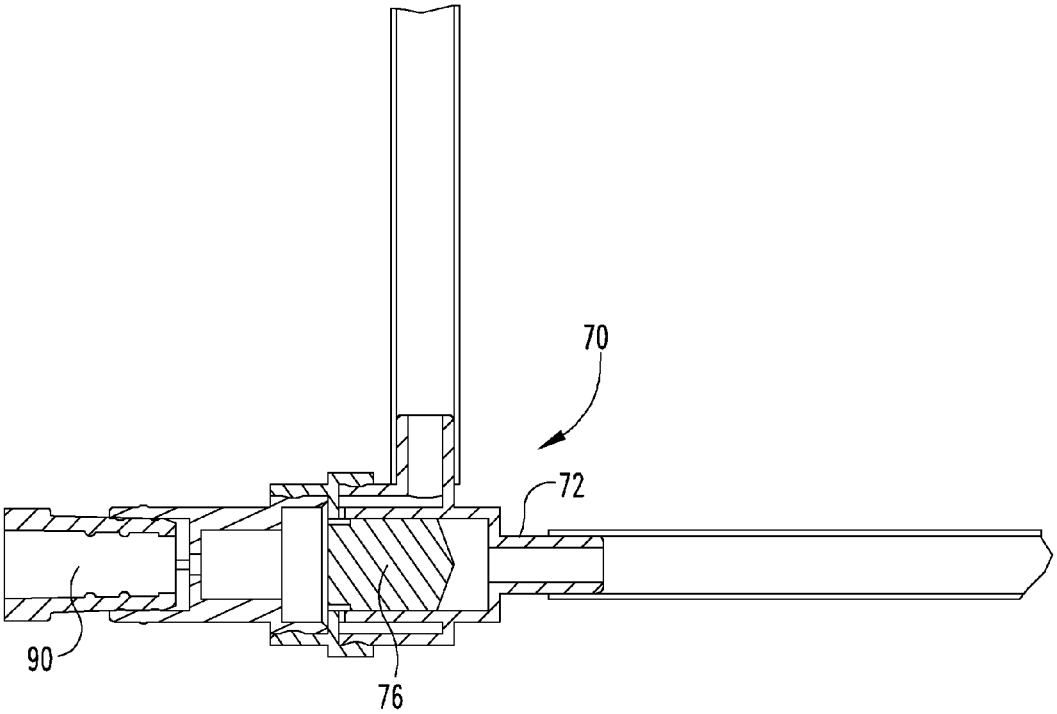
FIG. 5 is a partial, top plan view of a second mixing chamber construction which may be used as a part of the FIG. 1 dispensing device.
Figure 6:
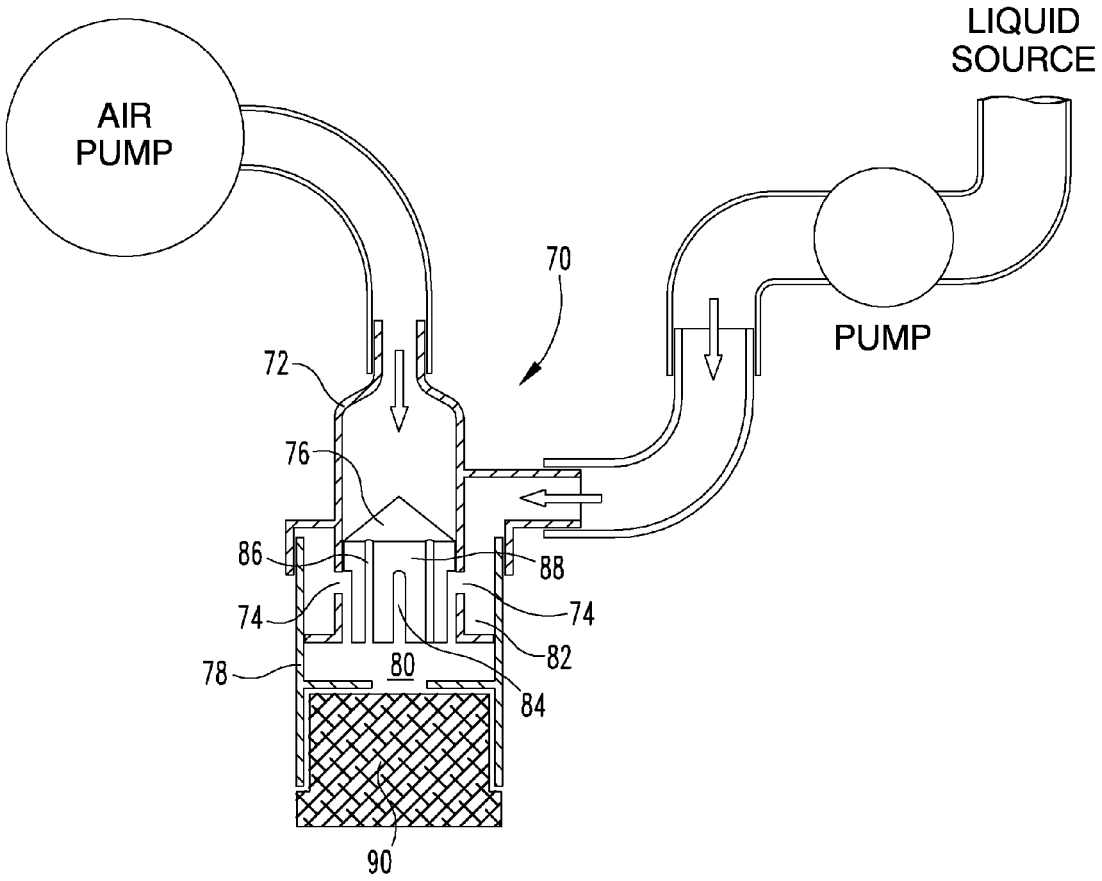
FIG. 6 is a diagrammatic view of the FIG. 5 mixing chamber.
Figure 6A:
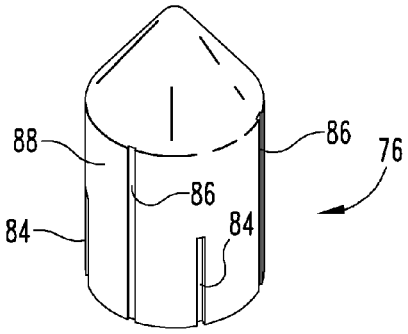
FIG. 6A is a perspective view of an air diffuser used in the FIG. 5 mixing chamber.

Referring now to FIGS. 5, 6 and 6A, a second embodiment for mixing chamber 70 is disclosed. Mixing chamber 70 is suitable for use with dispensing device 20 and is intended to be represented by FIG. 5. The diagrammatic view of FIG. 6 and the air diffuser perspective view of FIG. 6A are similar to FIGS. 4 and 4A in some respects. Accordingly, the structural differences associated with mixing chamber 70 as compared to mixing chamber 30 will be described.

In the second embodiment as represented by mixing chamber 70, the air inlet 72 is now configured with flow openings 74 so as allow liquid to flow radially inwardly toward the air diffuser 76. The housing extension 78 is constructed so as to close off any passageway or opening for the flow of liquid directly into the mixing pocket 80. Instead, with the lower end of the cylindrical space 82 closed off, all of the liquid must flow inwardly toward the outer surface of the diffuser 76 which is constructed with four liquid flow grooves 84 which are alternately arranged with the four air channels 86 which extend substantially the full length or height of the diffuser body 88 (see FIG. 6A). The liquid flow grooves 84 are not full height relative to body 88 as they each begin at approximately the location of the flow opening 74. The result of this flow pattern of air and liquid is to introduce eight separate flow streams into the mixing pocket 80. There are four flow streams of air alternating with four flow streams of liquid in a circumferential direction around the body of the air diffuser 76. This pattern of eight flow streams results in improved mixing of the two constituents within mixing pocket 80 before the mixture is pushed through the mesh insert 90.

While the invention has been illustrated and described in detail in the drawings and foregoing description, the same is to be considered as illustrative and not restrictive in character, it being understood that only the preferred embodiment has been shown and described and that all changes, equivalents, and modifications that come within the spirit of the inventions defined by following claims are desired to be protected. All publications, patents, and patent applications cited in this specification are herein incorporated by reference as if each individual publication, patent, or patent application were specifically and individually indicated to be incorporated by reference and set forth in its entirety herein.

The invention claimed is:

1. A mixing chamber for two fluid constituents comprising:

a first flow conduit for a first fluid constituent;

a diffuser positioned in said first flow conduit for directing flow of said first fluid constituent, said diffuser having a first free end, a second free end and a generally cylindrical body between said first free end and said second free end;

a second flow conduit for a second fluid constituent;

said first flow conduit being in flow communication with said second flow conduit for a flow of second fluid constituent to be arranged in a flow pattern around said diffuser;

a mixing pocket constructed and arranged for receiving said two fluid constituent flows; and wherein said diffuser having an outer surface and being constructed and arranged with an overall axial length extending from said first free end which faces the flow of said first fluid constituent to said second free end which is adjacent said mixing pocket, wherein the directed flow of said first fluid constituent flows over said outer surface for the entirety of said overall axial length.

2. The mixing chamber of claim 1 wherein said first end of said diffuser having a proximal portion which faces said flow of said first fluid constituent.

3. The mixing chamber of claim 1 wherein said first fluid constituent is air.

4. The mixing chamber of claim 1 wherein said second fluid constituent is liquid.

5. The mixing chamber of claim 1 wherein said diffuser defines a plurality of flow channels in said outer surface.

6. The mixing chamber of claim 1 wherein the second end of said diffuser includes a tapered skirt.

7. The mixing chamber of claim 6 wherein said skirt is frustoconical in shape.

8. The mixing chamber of claim 6 wherein said skirt defines a plurality of flow channels.

9. The mixing chamber of claim 1 wherein said first flow conduit defines a flow space around said diffuser.

10. A dispensing device comprising:

a liquid reservoir for retaining a liquid;

a first supply for delivering liquid from said liquid reservoir to a remote site;

a second supply for delivering air to said remote site;

a housing which is constructed and arranged in communication with said first supply and with said second supply;

a mesh insert assembled into said housing; and a mixing chamber which is received within said housing, said mixing chamber including an air diffuser and a mixing pocket wherein said mixing pocket is positioned between said air diffuser and said mesh insert, said air diffuser being constructed and arranged with a first free end, a second free end and a generally cylindrical body between said first free end and said second free end, said air diffuser being positioned in said second supply wherein said first free end having a proximal surface facing an incoming flow of air for directing said flow of air over said proximal surface wherein said mesh insert is spaced apart from and positioned exteriorly of said diffuser.

11. The dispensing device of claim 10 wherein said remote site is located within said mixing chamber.

12. The dispensing device of claim 10 wherein said diffuser defines a plurality of flow channels extending along a diffuser body.

13. The dispensing device of claim 10 wherein said diffuser includes a tapered skirt disposed at one end of said diffuser.

14. A dispensing device comprising;

a housing defining an air flow path and a liquid flow path;

air delivery means for delivering air to said air flow path;

liquid delivery means for delivering liquid to said liquid flow path;

a mixing chamber including an air diffuser, wherein said air diffuser being constructed and arranged with a first free end, a second free end and a generally cylindrical body between said first free end and said second free end, said first free end having a proximal surface which faces a flow of said air; and wherein said housing is constructed and arranged to direct a flow of liquid radially inwardly to engage said air diffuser and wherein the mixing of air and liquid occurs exteriorly of said diffuser.

15. The dispensing device of claim 14 wherein said air diffuser defines a liquid flow groove.

16. The dispensing device of claim 14 which further includes a mixing pocket and a mesh insert wherein said mixing pocket is axially positioned between said air diffuser and said mesh insert.

17. A mixing chamber for two fluid constituents comprising:

a first flow conduit for a first fluid constituent;

a diffuser positioned in said first flow conduit for dividing flow of said first fluid constituent into a plurality of flow streams, said diffuser having a first free end, a second free end and a generally cylindrical body between said first free end and said second free end;

a second flow conduit for a second fluid constituent;

said first flow conduit being in flow communication with said second flow conduit for a flow of second fluid constituent to be arranged in a flow pattern which surrounds said diffuser; and a mixing pocket constructed and arranged for receiving said two fluid constituent flows, wherein said first free end having a proximal surface with a tapered shape, said proximal surface being received in said first flow conduit and facing said flow of said first fluid constituent, wherein said first and second flows move past said second free end before entry into said mixing pocket.

18. The mixing chamber of claim 17 wherein said diffuser includes a tapered skirt disposed at said base end of said diffuser.

19. A dispensing device comprising:

a housing defining an air flow path and a liquid flow path;

a mesh insert received by said housing;

air delivery means for delivering air to said air flow path;

liquid delivery means for delivering liquid to said liquid flow path;

a mixing chamber constructed and arranged to receive a flow of air and a flow of liquid;

an air diffuser positioned in said air delivery means, wherein said air diffuser having a tapered surface at a first free end which faces a flow of said air; and wherein said air diffuser further including a tapered skirt at an opposite free end for directing air into a flow of said liquid and a generally cylindrical body between said first free end and said opposite free end, wherein said mesh insert is spaced apart from and positioned exteriorly of said diffuser.

20. The dispensing device of claim 19 wherein said air diffuser defines an air flow groove.

21. The dispensing device of claim 19 which further includes a mixing pocket which is axially positioned between said air diffuser and said mesh insert.

* * * * *